US005833556A

United States Patent [19]

Ferrari

[11] Patent Number: 5,833,556

[45] Date of Patent: Nov. 10, 1998

[54] GAME FOR PERFECTING BASKETBALL ARC

[76] Inventor: Philip F. Ferrari, 22W.601 Sunset Ter., Medinah, Ill. 60157

[21] Appl. No.: 840,286

[22] Filed: Apr. 14, 1997

[51] Int. Cl.[6] ..... A63B 69/00

[52] U.S. Cl. ..... 473/448

[58] Field of Search ..... 472/448; 273/400, 273/401, 402

[56] References Cited

U.S. PATENT DOCUMENTS

| | | | |
|---|---|---|---|
| 613,383 | 11/1898 | Morgan | 273/462 |
| 2,039,794 | 5/1936 | Hayden | 473/448 |
| 3,602,504 | 8/1971 | Chapman et al. | 273/402 X |
| 4,079,939 | 3/1978 | Raistakka | 273/402 |
| 4,226,416 | 10/1980 | Callanan | 473/448 |
| 4,828,270 | 5/1989 | Chiang | 273/401 |
| 5,558,323 | 9/1996 | Lofaso, Sr. | 473/448 |

*Primary Examiner*—William H. Grieb
*Attorney, Agent, or Firm*—Kajane McManus

[57] ABSTRACT

The game for perfecting the arc of a basketball as it travels toward a hoop includes a vertically oriented ring which is positioned a predetermined height above and distance away from the basketball, the ring defining a target area through which the basketball must pass to ensure passage through the hoop. Play of the game includes the awarding of points for each basketball shot, with the greatest number of points awarded for a shot wherein the basketball passes through the ring and hoop without contact and no points awarded where the basketball does not at least pass through the ring.

11 Claims, 2 Drawing Sheets

GAME FOR PERFECTING BASKETBALL ARC

BACKGROUND OF THE INVENTION

The present invention relates to a game used to teach a player his individual, desired basketball arc to assure the making of a basket. More specifically, the game includes rules of play and a selectively positionable, vertically oriented target ring through which the ball must pass unhampered for an individual player to be assured that the arc created by the thrown ball will lead into the basketball hoop, or basket.

PRIOR ART

Heretofore, learning to throw a basketball through an arc and into the basket has been a hit or miss type of achievement, with the player being considered either skilled or unskilled, naturally.

Further, an aid in training a player to recognize, with repeatability, the precise individual arc, for himself, has not been available, particularly in a form where the training takes on the characteristics of a game.

SUMMARY OF THE INVENTION

Accordingly, it is a primary object of the invention to provide a basketball game having rules of play therefor and incorporating structure which is selectively positionable, relative to the basket, which defines a target area for the individual player to pass the ball through during the ball's arc toward a basket, essentially guiding the ball into the basket, the target substantially assuring the making of the basket.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
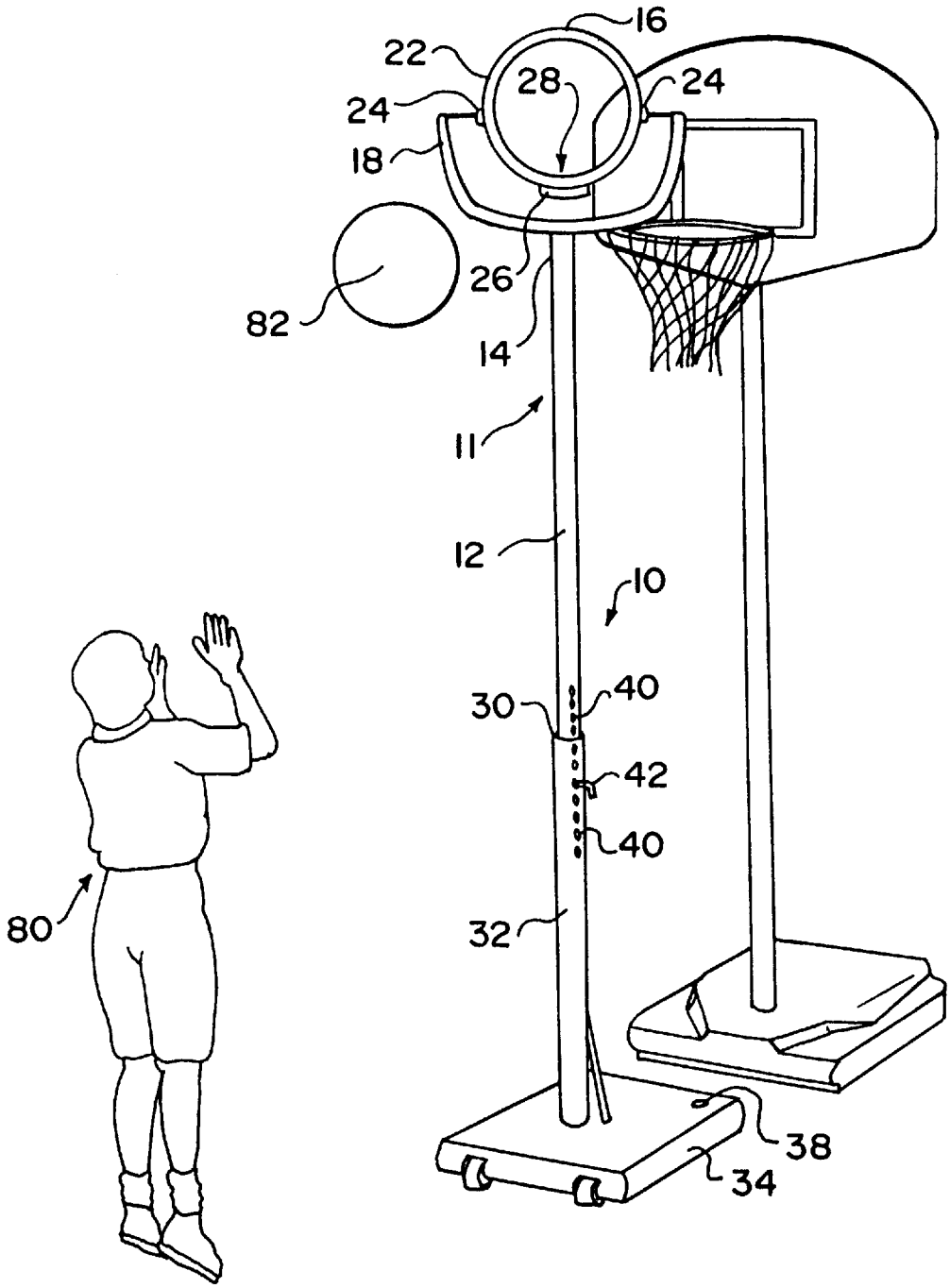
FIG. 1 is a perspective view of a first free standing embodiment of the target defining structure of the game, showing a player attempting to pass a ball through the target, toward the basket.

Referring now to the drawings in greater detail, there is illustrated therein a target defining structure 10 for use in playing the game of the present invention.

The structure 10 includes an upper section 11 having a tube 12 which mounts at one end 14 thereof a pivotable ring 16. The pivotable ring 16 is engaged to the tube 12 by means of a brace 18 which extends upwardly from the tube end 14, about a circumference 22 of the ring 16 and engages the ring 16 at diametric points 24 along the circumference 22 in a manner that allows the ring 16 to pivot within the brace 18, about the diametric points 24 of attachment thereto.

To assure the return of the ring 16 to a desired vertical position thereof, a mass 26 is engaged to the ring 16 at a point 28 along the circumference 22 which is equidistant from the diametric points 24 of attachment to the brace 18, such mass 26 always ensuring a return to the vertical orientation for the ring 16, under the effect of gravity.

In FIG. 1, a second free end 30 of the tube 12 is seen to be slidingly or telescopically received within a cooperating sleeve 32 of a base member 34, here shown to comprise a thick wheeled platform 34 from which the sleeve 32 extends upwardly at a substantially centered position. The platform 34 may be a hollow structure 34, defining a chamber 36 therewithin into which a heavy substance, such as sand or water, may be poured, via a fill port 38 thereof, to stabilize the base member 34 against tipping over.

Relative maintainable positioning between the sleeve 32 and the tube 12 telescopically seated within the sleeve 32 may be created in any suitable known manner, such as by creating a plurality of aligned cooperating throughbores 40 in the sleeve 32 and the tube 12, and, upon desired alignment being achieved therebetween, sliding a locking pin 42 through the aligned throughbores 40.

Figure 3:
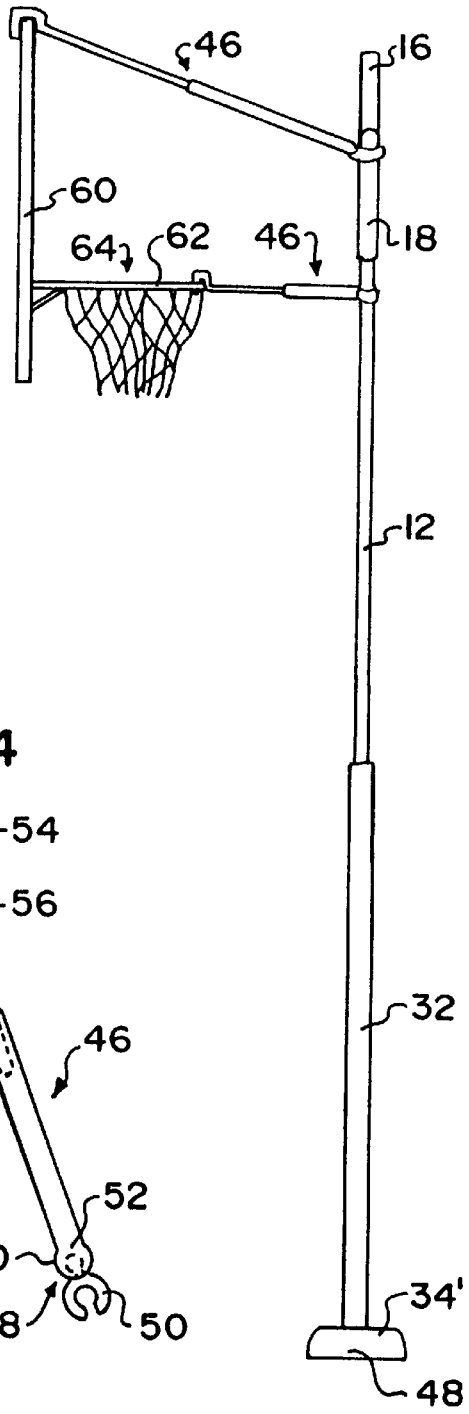
FIG. 3 is a side view of the structure of FIG. 2.
Figure 2:
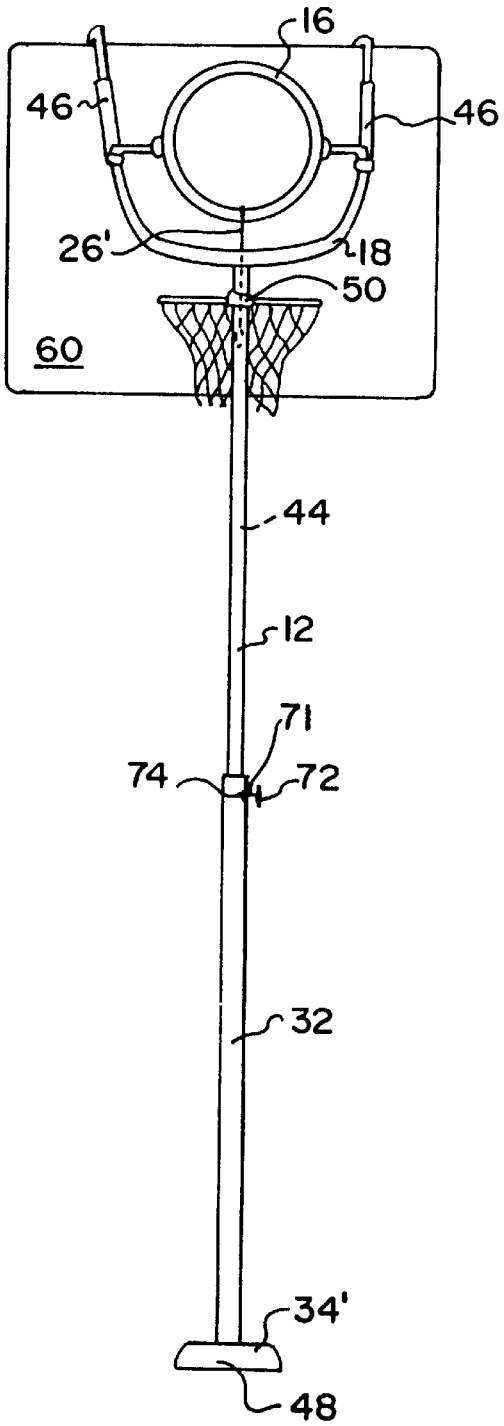
FIG. 2 is a perspective view of a second embodiment of the target indicating structure, this embodiment depending upon a floor and fixed in place structures of basketball hoop for support.

Turning now to the further embodiment of the target defining structure 10' shown in FIGS. 2 and 3, it will be seen that the upper section 11 comprising the tube 12, brace 18, and ring 16 is nearly identical to that shown in FIG. 1 except for configuration of the mass 26', which here is illustrated as a weighted plumbline 26' which drops into an interior chamber 44 defined within the tube 12. The base member 34', however, is shown here as a simplified embodiment and requires provision of support arms 46 for use therewith.

In this respect, it is seen that the base member 34' to which the sleeve 32 is joined in this embodiment, comprises a small, floor supported suction cup 48.

To provide for vertical stability of the structure 10', it is proposed to provide a plurality of the support arms 46 which each have a first connector element 50 at one end 52 thereof for engaging the upper section 11 of the structure 10' and each have a second connector element 54 at a second end 56 thereof for engaging an adjacent, fixed in place structure, such as a backboard 60 or rim 62 of a basketball hoop 64.

To allow for adjustment of relative position between the target ring 16 and the basketball hoop 64, each arm 46 must include a telescopically configured shaft 66, and accommodate any of a plurality of vertical and horizontal positions as well.

Vertical and horizontal positioning is accommodated by providing at least one point 68 of pivotability along the shaft 66.

Due to the telescoping nature of the shaft 66, in a preferred embodiment, the point 68 of pivotability is produced by, for example, a ball and socket joint 70 at a location adjacent one connector element 50 or 54.

Figure 4:
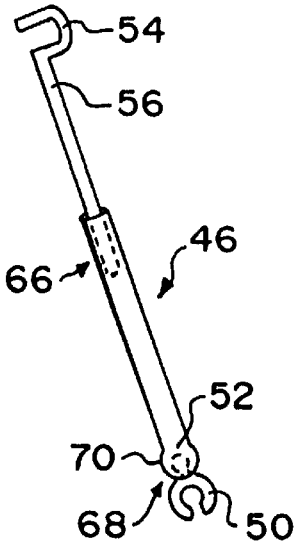
FIG. 4 is an enlarged view of an arm of the embodiment of FIGS. 2 and 3.

In FIG. 4, the second connector element 54 is illustrated as a hook 54 which merely drops over the backboard 60 while the first connector element 50 is illustrated as a snap on clip or clamp 50 which releasably engages structure of the upper section 11. As an example it is shown here that one arm 46 may engage to and between the tube 12 and the basketball hoop 64 and that two further arms 46 may engage to and between the ring brace 18, and the backboard 60, one arm 46 placed to each side of the ring 16 for lateral stability.

Also, in FIG. 2 a frictional engagement between the tube 12 and the sleeve 32 is shown in a second embodiment, wherein a rotatable bolt 70 having a handle 72 is engaged through a bore 74 in the sleeve 32, and upon inward rotation, the bolt 70 frictionally engages the tube 12, holding same in place.

It will be understood that these embodiments are selected for purposes of illustration only and are not to be construed as limiting.

The game using the structure 10, 10' can be played one on one, or team against team.

For one on one play, 21 points is set as the goal. For two man teams, 32 points is set as the goal. For four man teams, 42 points is set as the goal. A coin is flipped to determine a beginner.

As stated above, the structure 10, 10' is adjustable to meet requirements of players 80, individually, for purposes of practice. However, in such play of a game, using a free throw line to shoot from, unless there is an extreme difference in player 80 height, the structure 10, 10' may be positioned for game use, in a single position, which is more or less generic for players of substantially similar height, such position being empirically determined before start of play.

It has been found through empirical testing that a few basic relative positions for the ring 16 are required to accommodate a wide plurality of player 80 heights. The positions for the ring 16 relative to the rim 62 of the basketball hoop 64 based on the height of the player 80 is set forth below in table form.

Typically, a basketball hoop rim 62 is ten feet above tide floor and the distance above the rim 62 for the ring 16 set forth below is measured from a center point of the ring 16.

| HEIGHT OF PLAYER | DISTANCE AT WHICH CENTER POINT OF RING 16 IS POSITIONED ABOVE BASKETBALL HOOP RIM 62 | DISTANCE OF RING 16 FROM CENTER POINT OF BASKET BALL HOOP RIM 62 |
|---|---|---|
| 5'0" to 5'5" | 0' - 10" | 7' - 8½" |
| 5'6" to 5'11" | 1' - 3" | 7' - 8½" |
| 6'0" to 6'5" | 1' - 7" | 7' - ½" |
| 6'6" to 7'0" | 1' - 10" | 7' - ½" |

The method of play following describes a one on one scenario. It will be understood that teams and the team players rotate turns and shoot in the same manner and that, for the purposes of brevity, team rotation will not be described.

Player 1 places himself behind a free throw line 15' from the backboard 60, and begins to attempt shooting basketballs 82 through the ring 16 and basketball hoop 64. If the ball 82 does not touch the ring 16, basketball hoop 64 or backboard 60 and falls through the hoop 64 cleanly, 3 points are earned. If the ball 82 touches the ring 16 without touching the hoop 64 or backboard 60 and falls through the hoop 64, two points are earned. If the ball 82 touches two of the three structures and falls through the hoop 64, one point is earned. No points are given for a ball 82 touching all the structures but the player 80 doesn't lose his turn and keeps shooting until he misses making the basket. When and if player #1 misses making the basket, player #2 gains possession of the ball and begins shooting. Whoever reaches 21 points first wins the game.

It will be seen that the ring 16 defines a target area for the ball 82 to arc through for assurance of making a basket when correctly positioned relative to the basket for the particular player or team. By providing such visual indication, and when used repetitively, it has been found that a player 80 becomes trained to reproduce his individual winning arc time after time.

As described above, the game and structure 10, 10' thereof provide a number of advantages, some of which have been described above and others of which are inherent in the invention. Also, modifications may be proposed without departing from the teachings herein. Accordingly the scope of the invention is only to be limited as necessitated by the accompanying claims.

I claim:

1. A game for perfecting the arc of a basketball thrown toward a hoop, the game comprising a vertically oriented ring which is pivotably engaged to a brace which is fixed to a tube which is telescopically received within a sleeve of a base member the ring being positioned a predetermined distance above and away from said hoop and defining a target area through which the basketball must pass to ensure travel through the hoop.

2. The game of claim 1 wherein said base member is a wheeled, fillable, hollow platform from which said sleeve extends upwardly in a substantially centered position relative to the platform.

3. The game of claim 1 wherein said base member comprises a suction cup which engages an end of said sleeve.

4. The game of claim 3 wherein a plurality of support arms are provided for engaging said ring brace and tube to said hoop and support structures of said hoop.

5. The game of claim 4 wherein said support arms are telescopic.

6. The game of claim 5 wherein said support arms include a connector element at first and second ends thereof.

7. The game of claim 6 wherein each support arm includes at least one point of pivotability along a length thereof.

8. The game of claim 1 wherein said ring includes a weight engaged thereto, said weight being positioned thereon in a manner to ensure vertical orientation of said pivotable ring, under the effect of gravity.

9. The game of claim 1 wherein relative position between said tube and said sleeve is releasably fixable.

10. The game of claim 1 wherein play comprises the steps of:

locating the ring at a predetermined position relative to said hoop;

shooting a basketball toward and through said ring, and into said hoop;

and awarding points for each shot, with a greatest number of points being awarded for a shot wherein the basketball does not contact the ring or the hoop, and a least number of points being awarded for a shot wherein the basketball contacts both the ring and the hoop.

11. The game of claim 10 wherein no points are awarded for a shot wherein the basketball does not pass through at least the ring.

* * * * *